United States Patent [19]

Legris et al.

[11] Patent Number: 4,745,845

[45] Date of Patent: May 24, 1988

[54] COMPRESSED AIR FLOW REGULATING DEVICES

[75] Inventors: André Legris, Rennes; Yvés Levenez, Vaux Le Penil, both of France

[73] Assignee: Societe Anonyme Styled LEGRIS, France

[21] Appl. No.: 752,198

[22] PCT Filed: Nov. 26, 1984

[86] PCT No.: PCT/FR84/00277

§ 371 Date: Jun. 27, 1985

§ 102(e) Date: Jun. 27, 1985

[87] PCT Pub. No.: WO85/02446

PCT Pub. Date: Jun. 6, 1985

[30] Foreign Application Priority Data

Nov. 29, 1983 [FR] France ..... 83 19059

[51] Int. Cl.[4] ..... F15B 11/08; F15B 13/04

[52] U.S. Cl. ..... 91/443; 91/420; 91/444; 91/463

[58] Field of Search ..... 91/443, 444, 420, 463

[56] References Cited

U.S. PATENT DOCUMENTS 3,093,159 6/1963 Royle .
3,119,306 1/1964 Colonius ..... 91/443
3,473,571 10/1969 Dugay .
3,509,968 5/1970 Gregory .
3,532,119 10/1970 Lind .
3,974,742 8/1976 Johnson ..... 91/443

FOREIGN PATENT DOCUMENTS 6915281 4/1971 Netherlands .
372931 12/1963 Switzerland .
968268 9/1964 United Kingdom .

*Primary Examiner*—Douglas Hart
*Attorney, Agent, or Firm*—Brumbaugh, Graves, Donohue & Raymond

[57] ABSTRACT

A flow regulating device is placed between a compressed air distributor and a double-acting jack for regulating the admission and exhaust flow of compressed air. The device includes a body with a cylindrical housing in which is mounted for axial sliding a movable member, and within which are two passageways transversed perpendicular to the body. Each passageway issues into a chamber defined by a bottom, the housing and the movable member. The two chambers are isolated by the movable member which comprises a central seal. The opening of the passageways are defined by stop members placed at both ends of the housing.

20 Claims, 5 Drawing Sheets

COMPRESSED AIR FLOW REGULATING DEVICES

The present invention relates to an improvement in compressed air flow regulating devices which are placed between a conventional distributor of compressed air and a pneumatic jack.

To reduce the speed of pneumatic jacks, it is known to use flow regulating devices which comprise an adjustable reduced passage for regulating the flow in one direction, and shunted on said reduced passage, a valve which, being closed by the pressure in that direction, opens in the other to allow the full flow. Flow regulating devices are used either to regulate the admission flow into the driving chamber of the jack, or to regulate the flow discharged into the atmosphere from the other exhaust chamber. The admission flow being the only one regulated, the triggering of the jack is instantaneous, said exhaust chamber emptying very rapidly. This solution has the disadvantage, when the jack loads tend to drive the latter, to reduce the control of the speed which increases considerably. When pressure drop sensors are used, they can issue their end-of-stroke signals well before the actual end of the stroke, due to the rapid disappearance of the exhaust counter-pressure. The exhaust flow being the only one regulated, trigerring of the jacks is slow, due to the important volume of air to be evacuated through the constriction and it can be accompanied by jerks. Pressure drop sensors tend to deliver end-of-stroke signals which are all the more delayed that the passage constriction is great. The device for regulating the speed of a double acting jack is therefore constituted of at least two flow regulators either of the admission flow or of the exhaust flow.

However, in order to derive all the advantages inherent in each of these two methods, it is often necessary to fit four regulating devices and the adjustments become very complicated. Hydraulic distributors are also known in which the slide valve is auto-piloted and subjected on its two faces to the action of springs. But this device, being used with incompressible liquids, has passages which supply flows and and do not permit, as in the present invention where compressible gases are involved, to limit the speed of a jack by controlling the air flow.

Moreover, the low viscosity of the air could generate vibration phenomena which are unacceptable to the balance between the two springs.

Finally, said known device does not enable a ready adjustment of the position of the slide valve by means of movable abutments. The device according to the present invention enables to eliminate the drawbacks related to the use of the known regulators and devices for regulating the speed of pneumatic actuating means such as pressure cylinders or jacks.

According to the present invention, the air flow regulator comprises a body having a cylindrical housing limited by two bottoms and in which is mounted for axial sliding a movable revolving member of which the stroke is limited at each end of the housing by an adjustable abutting member, said body being traversed, perpendicularly to said cylindrical housing, by two passageways supplying the jack, each of which passageways issues into a chamber defined by the bottom, the cylindrical housing and the movable member, said movable member comprising central tightness means isolating the two chambers defined at the two ends of the bistable housing, regulating the opening of the passageways in relation to the position of the abutting members situated at the two ends of the housing, in such a way as to cause a regulation of the air supplying and draining flows of the two volumes of air of the double-acting jack, and this in every moving direction of the cylinder piston.

The device according to the invention enables to regulate, in both ways of the stroke, the admission flow as well as the exhaust flow, using the same regulation for the two directions. Said flow regulator which is placed between a compressed air distributor and a pneumatic jack enables to adjust the speed of the piston of a jack in every direction.

It comprises no return valve. For a given value of adjustment, the cross-sections of the passage orifices provided for the return flows may be equal or different, or have a variable ratio between them, in which latter case, it is possible to use the same regulating operation for the two alternances permitting to favor the admission passage at the expense of the exhaust passage, and vice versa. The flow regulating device according to the invention joins up, via its two inlet orifices, with the two outlet orifices of a distributor and by its two outlet orifices with the two inlet orifices of a double-acting jack.

With the device according to the invention, due to the fact that a movable closing member is used on the exhaust, the reversing of the movement of the piston of the jack is dependent on an adequate pressure difference between the chambers of the regulator and the triggering of the jack with the double regulator is much more instantaneous in draining adjustment than with the conventional regulators.

Other characteristics and advantages of the invention will emerge on reading the following description of several embodiments, reference being made to the accompanying drawings, in which.

Figure 1:
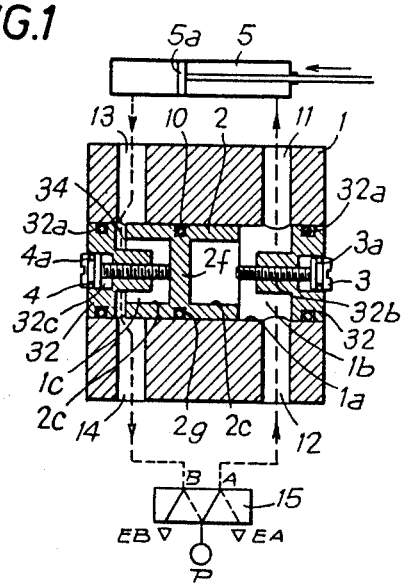
FIG. 1 is an axial cross-section of a compressed air flow regulating device according to the invention connected to a distributor and to a jack.
Figure 2:
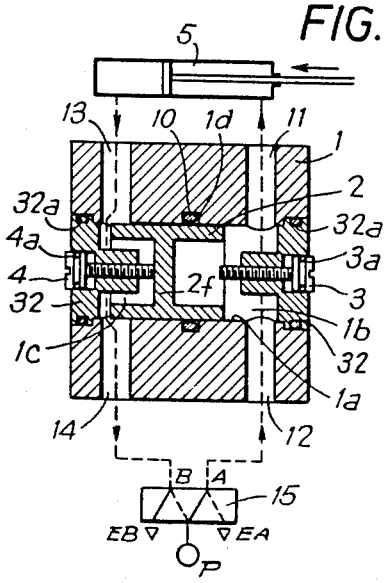
FIG. 2 is a similar view of a flow regulating device with other tightness means for the movable member.

FIGS. 1 and 2 show one embodiment of a flow regulating device which is placed between a compressed air distributor 15 and a double-acting jack 5. Said flow regulating device comprises a body 1 with a cylindrical bore or housing 1*a* limited by two bottoms and in which is mounted for axial sliding a revolving movable body 2 the stroke of which is limited at each end of said housing by an abutting member constituted by a screw 3, 4, engaged in a tapped hole 32*b* of a plug 32 closing off the two ends of the cylindrical housing 1*a*, said plug being force-fitted in said housing 1*a* with interposition of an annular seal 32*a* placed inside a groove of the plug 32.

The head of the screws 3,4 is engaged in a blind hole 32*c* provided in the plugs 32, with interposition of an annular seal 3*a*, 4*a*.

Said body 1 is traversed, perpendicularly to housing 1*a* by two passageways 11, 12 and 13, 14 supplying the jack 5, said passageway 11, 12 issuing into a chamber 1*b* and said passageway 13, 14 issuing into a chamber 1*c*. Chambers 1*b* and 1*c* are defined by plug 32, the cylindrical housing 1*a* and the movable member 2, which movable member is provided with a central annular seal 10, placed inside a groove 2*g* of said movable member and achieves isolation between the two chambers 1*b* and 1*c*.

Said movable member 2 is constituted of a single cylindrical piece (FIGS. 1,2) which has a central wall 2*f* defining on each side a recess 2*c*, and against which screws 3 and 4 are adapted to abut in order to regulate the stroke of the movable member 2.

The body 1 of the flow regulating device is connected via its portions of conduits 11, 13 to jack 5 and by its portions of conduits 12, 14 to the distributor of compressed air which is connected to a source P of compressed air and to exhausts EA and EB opening out to the atmosphere.

When the slide valve of the distributor is as illustrated in FIGS. 1 and 2, it feeds compressed air to the portion of conduit 12, thus pushing back the movable member 2 which acts as a piston towards the right, and supplying through housing 1*a* and portion of conduit 11, one of the sides of jack 5.

The movable member is in abutment on the end of the screw 4 which has been adjusted beforehand to more or less close off the passage orifice corresponding to conduit 13, 14 connected to the chamber of jack 5 which discharges through the distributor 15. As a result, the air flow released from jack 5 is regulated by the orifice defined between the circular edge 34 of the movable member and the orifices of the portions of conduits, 13, 14, the position of the movable member 2 being determined by the position of the screw 4.

The control of the air flow released through conduit 13, 14 also controls the moving speed of the piston 5*a* of jack 5, since said speed is dependent on the resistance opposed by the air released through conduit 13, 14 of which the orifice is more or less obturated.

The regulating device according to FIG. 1 also enables to control the exhaust flow, the admission being wide open and this in both directions.

In like manner, the screw 3 is controlled in such a way as to more or less close off the orifices of conduits 11, 12 when the admission is through conduit 13, 14 and when the movable member 2 is pushed towards the right.

The bistable movable member 2 abutting left or right depending on the cycle of the jack, more or less closes, depending on the adjustment of the stop screws 3,4, the passage orifices of conduits 11, 12 and 13, 14 and in doing so regulates the draining air flows in each direction.

In FIG. 2, the seal 10 ensuring tightness between chambers 1*b* and 1*c* is mounted in a groove 1*d* provided in the body and is in contact with the external cylindrical surface of the movable member 2.

Figure 3:
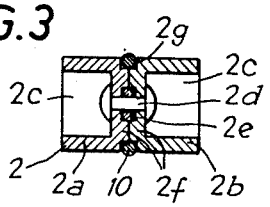
FIG. 3 is a cross-section of another embodiment of the movable member.
Figure 4:
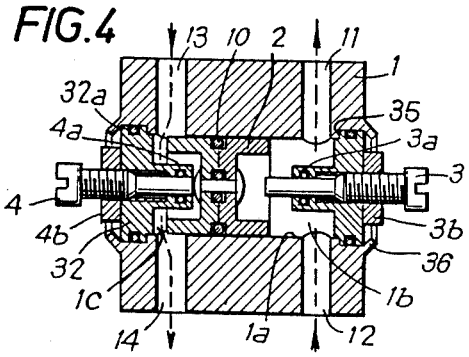
FIG. 4 is an axial section of a flow regulating device with another embodiment of the abutments.

FIGS. 3 and 4 illustrate another embodiment of the movable member 2 which is constituted of two identical elements 2*a*, 2*b* or complementary elements assembled by means of a rivet 2*d* or screw, said elements defining between them a housing inside which is placed a seal 2*e* disposed around said rivet 2*d*. Outside said two elements 2*a*, 2*b* and in their joining plane, there is provided a groove 2*g* designed to receive a seal 10.

The assembling of elements 2*a*, 2*b* facilitates the passage of seal 10 opposite passage conduits 11, 12 and 13, 14 inside housing 1*a* of body 1.

As illustrated in FIG. 3 and described hereinabove, the body 1 shown in FIG. 2 may be produced in two symmetrical or complementary parts.

In the embodiment illustrated in FIG. 4, stop screws 3 and 4 are mounted in plugs 32 so that their head extends outwardly. Screws 3 and 4 are equipped with lock-nuts 3*b* and 4*b* preventing them from unscrewing under the action of vibrations and the plugs 32 extended inside the recess 1*a* comprise grooves in which are placed seals 3*a*, 4*a*, around the stems of the screws 3 and 4.

The plugs 32 are fitted in the housing 1*a* with a shoulder 35 and they are held in position by a crimped edge 36.

Figure 5:
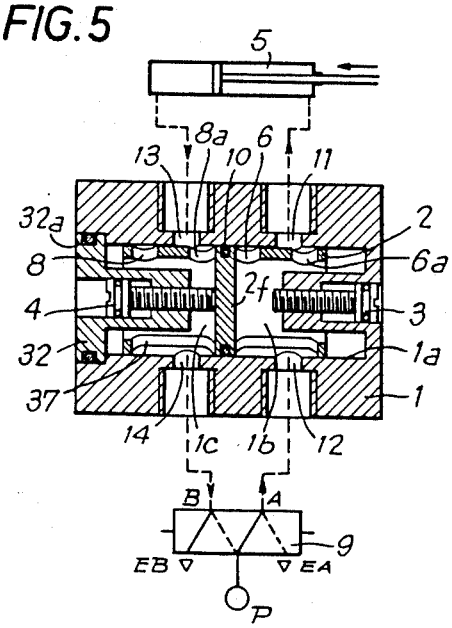
FIG. 5 is an axial section of a flow regulating device equipped with another embodiment of the movable member.

FIG. 5 illustrates another embodiment of the movable member 2 which comprises in its cylindrical part, holes 6, 6*a* and 8, 8*a* situated on each side of the central wall 2*f*, said holes which move opposite the orifices of the portions of conduits 11 and 13 of which the cross-section is substantially equal to that of holes 6, 6*a* and 8, 8*a*. The distance between holes 6, 6*a* and 8, 8*a* enables to vary the proportion of the flows between draining and supply.

Understandably, the movable member 2 comprises notches 37 to allow the flow of fluid towards the portions of conduits 12, 14 and said member is immobilized in rotation in order to keep the holes on the same longitudinal axis.

Figure 6:
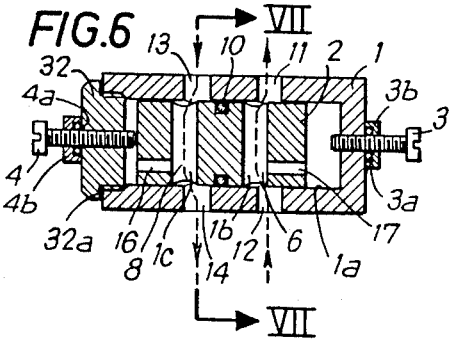
FIG. 6 is an axial section of a flow regulating device with a monoblock movable member.
Figure 7:
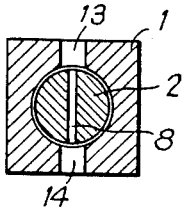
FIG. 7 is a cross-section along line VII—VII of FIG. 6.

FIGS. 6 and 7 illustrate another embodiment of the flow regulating device in which the housing 1*a* is closed on one side by a plug 32 screwed into the body 1, and on the other side, by a wall of the body 1. Screws 3 and 4 are equipped with lock nuts 3*b* and 4*b* which present a circular groove in which is inserted a seal 3*a* and 4*a*.

Said movable member 2 is constituted of a solid cylindrical body in which are provided channels 6 and 8 which come in a more or less obturating position over the orifices of the portions of conduits 11, 12 and 13, 14 depending on the adjustment of stop screws 3 and 4.

The action of the driving fluid is exerted on the movable member through channels 16, 17 issuing into the channels 6 and 8 and into the chambers 1*a* and 1*b*.

It can be noted: (a) that if the distance between channels 6–8 is the same as the distance between conduits 11–13 and 12–14, in each alternance, the value of the admission and exhaust passages is identical. (b) If the distance between the channels 6–8 is smaller than the distance between conduits 11–13 and 12–14, in each alternance the value of the admission passage is smaller than that of the exhaust passage. (c) If the distance between channels 6–8 is greater than the distance between conduits 11–13 and 12–14, in each alternance, the value of the admission passage is greater than that of the exhaust passage.

Figure 8:
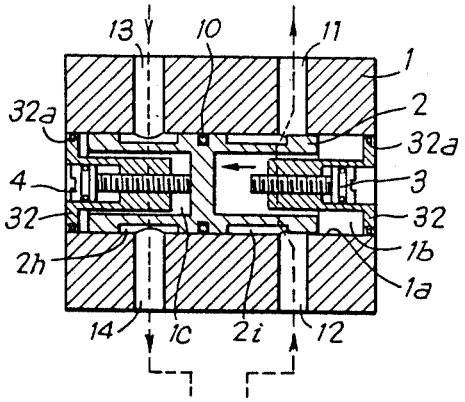
FIGS. 8 to 15 are axial sections of flow regulating devices equipped with members comprising grooves for controlling the air passage orifices.

FIG. 8 illustrates another movable member 2 in the body 1 of a flow regulating device. The movable member comprises two annular grooves 2*h* and 2*i*, disposed on either side of seal 10, said grooves being placed in such a way that the movable member 2 being in the meddle position of housing 1*a*, the conduits 11, 12 and 13, 14 are open at their maximum. In this device, the width of the grooves 2*h*, 2*i* is such that only the passage of admission conduit 11, 12 is reduced whereas the passage of exhaust conduit 13–14 remains fully open, whatever the adjustment of the stop screw 4. The same applies to the other alternance.

Figure 9:
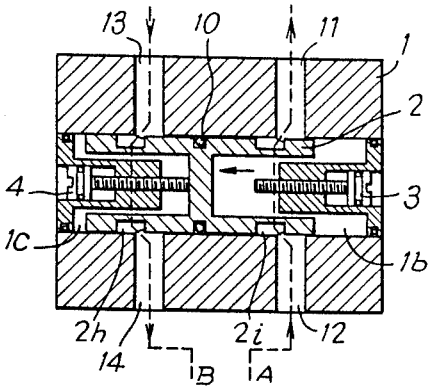

FIG. 9 illustrates another embodiment of the movable member 2 in which annular grooves 2*h* and 2*i* give a maximum opening of conduits 11, 12 and 13, 14 when movable member 2 occupies a position in the middle of housing 1*a*. In the position illustrated in FIG. 9, the width of the grooves 2*h* and 2*i* is such that the passage orifices of the admission and exhaust conduits are simultaneously reduced. Depending on whether the distance between the two grooves 2*h*, 2*i* of the movable member and of conduits 11, 12 and 13, 14 is equal or not, the restrictions of the passage orifices will be for all adjustment equal or unequal.

Figure 10:
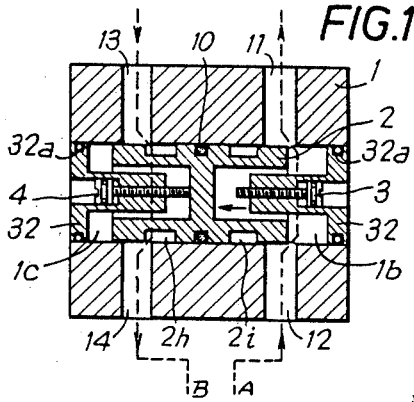

FIG. 10 illustrates another embodiment of the movable member 2 which comprises two annular grooves 2*h*, 2*i* disposed in such a way that the movable member occupies a position in the middle of housing 1*a*, conduits 11, 12 and 13, 14 are completely sealed off. In the embodiment illustrated in FIG. 10, the width of the grooves is such that the two passage conduits 11, 12 and 13, 14 are partly open, as in the preceding example, for all adjustments, the cross-sections of the passage orifices are equal or unequal depending on the distance between them compared to the distance between the conduits.

Figure 11:
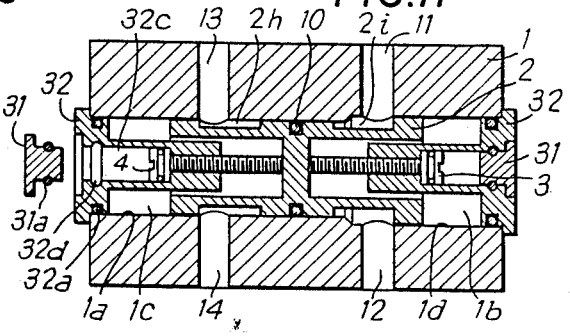

Said movable member enables to reduce the two passages in each alternance. In FIG. 11, is shown a flow regulating device in which the head of screws 3 and 4 is disposed in a blind hole 32*c* of plugs 32, said blind hole being closed by a closing member 31 which is force fitted and held by way of a seal 31*a* inserted in a groove 32*d*, provided in said plug 32. This disposition enables to prevent all access to screws 3 and 4 when the adjustment is carried out.

Figure 12:
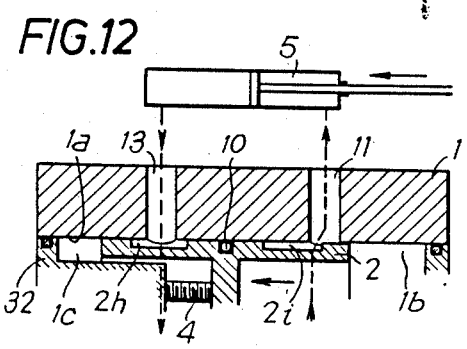

FIG. 12 shows the same movable member than in FIG. 8 in abutment on the screw 4 and in this case, only the conduit 11, 12 corresponding to the admission has a reduced cross-section, and consequently, the speed of the piston of jack 5 is adjusted by that restriction alone.

Figure 13:
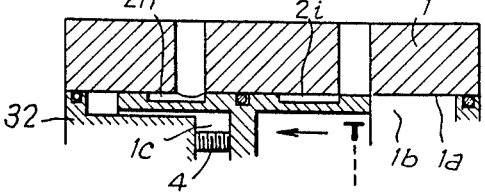

FIG. 13 shows the same movable member as before, in abutment on screw 4 which has been moved back with respect to its position as shown in FIG. 12. The cross-section of passage of admission conduit 11, 12 is kept completely closed whereas the passage cross-section of the exhaust conduit 13, 14 is completely open. The speed of the piston of the jack is nil.

Figure 14:
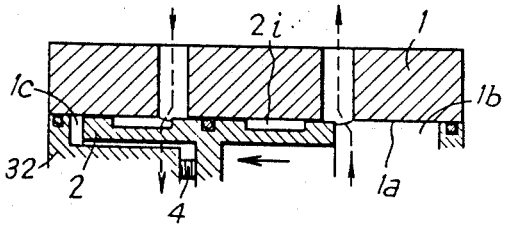

FIG. 14 shows the same movable member 2 on the stop screw 4 which has been set back with respect to the position shown in FIG. 13. This greater freedom of stroke given to the slide causes the partial closure in variable proportions depending on the adjustment of the screw 4, of conduits 11, 12 and 13, 14.

Figure 15:
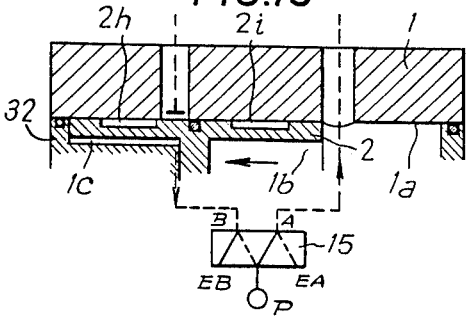
Figure 16:
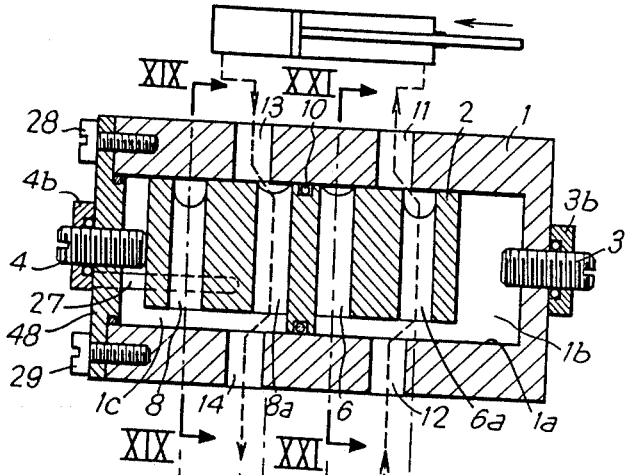
FIG. 16 is an axial section of a flow regulating device equipped with a movable member which is movable angularly and axially.

FIG. 15 shows the movable member 2 in abutting position against the screw 4 which has been set back to a maximum to permit a complete stroke of the movable member. In that position, the piston of the jack 5 stops with the full closure of the exhaust pipe 13, 14.

Said device thus permits, by simple adjustment of the screws 3 and 4, to select progressively and continuously, the mode of regulation of the speed of the piston of the jack in every alternative.

Figure 20:
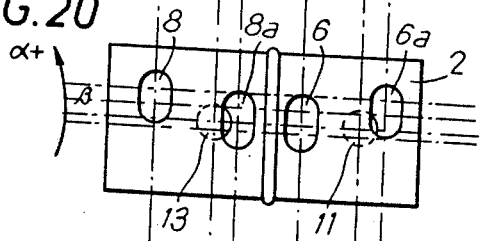
Figure 21:
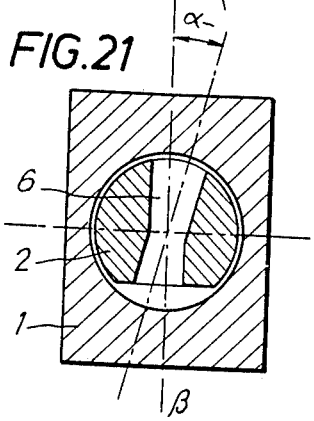
FIGS. 21 and 22 are cross-sectional and elevational views of the movable member in a position — of the flange.

In FIGS. 16 to 21, there is shown another embodiment of a flow regulating device in which the movable member 2 is provided with holes 6, 6*a* and 8, 8*a* which have been made beforehand on the same generatrix of a diameter $\beta$. Then, the holes 8 and 6*a* are angularly enlarged of a positive value $\alpha$ with respect to the common perforating axis $\beta$ (FIG. 19) and the holes 8*a*, and 6 are angularly enlarged of a negative value $\alpha$ with respect to said axis $\beta$ (FIG. 21).

At one of the ends of the body 1, is pivotally mounted a flange 48 provided with apertures 38, 39 in which are engaged screws 28, 29 secured in the body 1, said flange 48 being pivotable about the axis of the movable member 2 on the body 1 according to angles $\alpha+$ and $\alpha-$, and being lockable in the selected position by means of screws 28, 29.

Moreover, the flange 48 comprises a finger 27 which is mounted for sliding in a hole 40 of the movable member 2 in order to drive the latter in rotation when the flange 48 is actuated.

Figure 17:
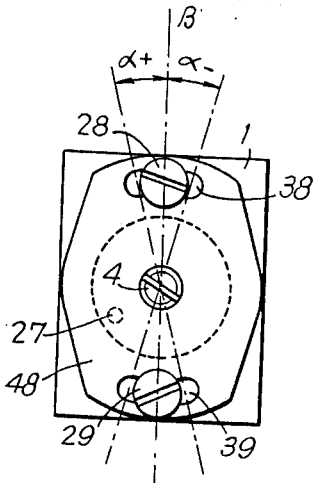
FIG. 17 is a view of one of the ends of the flow regulating device showing an adjusting flange.
Figure 18:
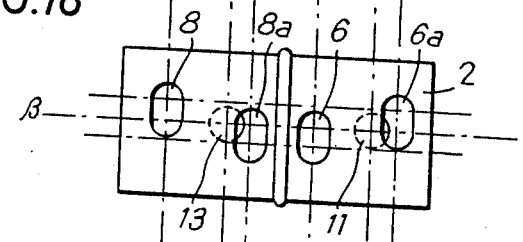
FIG. 18 is a view of the movable member and of the orifices for the median positioning of the adjusting flange of FIG. 17.
Figure 19:
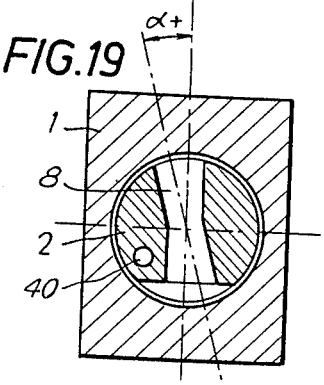
FIGS. 19 and 20 are cross-sectional and elevational views of the movable member in a position + of the flange.

In the middle position of said flange 48 such as indicated in FIG. 17, the movable member 2 occupies, in rotation, a position such that the axis $\beta$ coincides with the axes of the portions of conduits 11 and 13. FIG. 18 shows, in said conditions, the position of hole 8*a*, and of portion of conduit 13 as well as that of the hole 6*a* and of the orifice 11, the said positions being longitudinally determined by adjusting the stop screw 4, the passages of admission and exaust being then equal. A rotation of the flange 48 over an angle $\alpha+$ moves, by way of the finger 27, the movable member 2. For the same adjustment of the screw 4, it is shown in FIG. 20, that there is a predominance of the exhaust passage 13–8a over the admission passage 6a–11.

Figure 22:
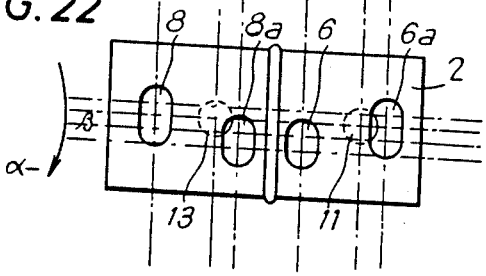

A rotation of the flange 48 and of the movable member 2 over an angle $\alpha-$ causes, as shown in FIG. 22, a reverse of the predominance. The geometrical shape of the holes of the movable member 2 is immaterial and it may be different from the circular cross-section for a better progressiveness of the adjustment of the opening of said passages. The flow regulators described hereinabove have the shape of a double fitting which is reversible as to the orientation of its connections with a distributor and with a jack.

Figure 23:
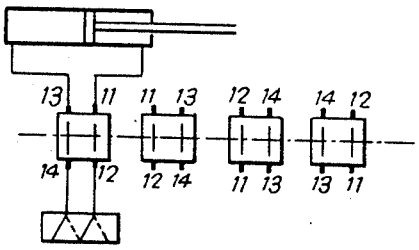
FIGS. 23 and 24 are diagrammatical views of the assembly of the flow regulating device.
Figure 24:
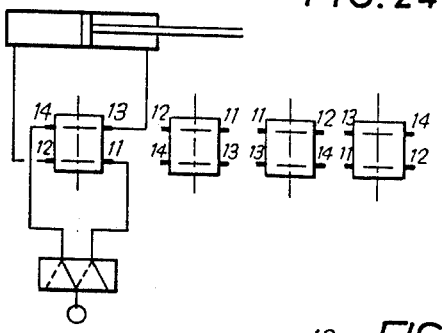
Figure 25:
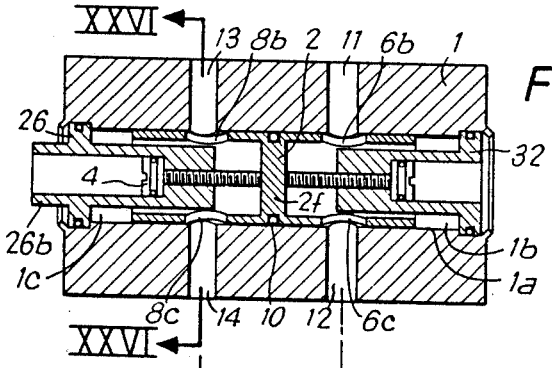
FIG. 25 is an axial section of the flow regulating device equipped with means of controlling the movable member.
Figure 26:
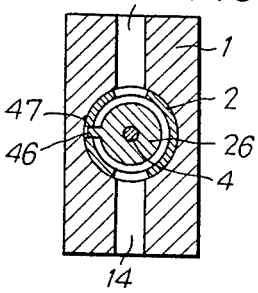
FIG. 26 is a cross-section along line XXVI—XXVI of FIG. 25.
Figure 27:
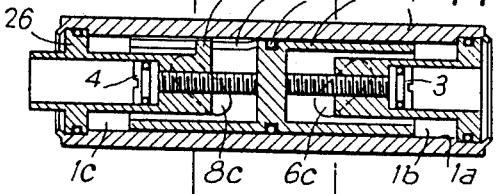
FIG. 27 is an axial section of the flow regulating device which is offset by 90° with respect to that shown in FIG. 25.
Figure 28:
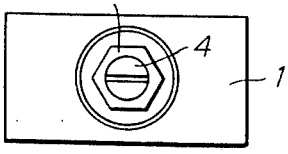
FIG. 28 is an end view of the flow regulating device shown in FIG. 27.

FIG. 23 illustrates the bodies of regulating devices arranged in four positions in which the connections are parallel. Whereas in FIG. 24, are shown the bodies of the bodies of regulating devices arranged in four positions in which the connections are crossed.

FIGS. 25, 26, 27, 28 show a flow regulating device comprising a flow regulator with a movable member 2 of the type illustrated in FIG. 1 and in which are provided oblong holes 8b, 8c, and 6b, 6c, the geometrical centers of holes 8b, 8c situated on the same side with respect to the seal 10 being diametrical, this applying also to holes 6b, 6c situated on the other side of seal 10. The geometrical centers of holes 8b and 6b are on the same generatrix and consequently holes 8c and 6c are on the diametrical generatrix. Said oblong holes extend along the same axis forming with their generatrix a positive angle for the holes 8b, 8c and a negative angle for the holes 6b and 6c.

The distance between the geometrical centers of holes 8b, 8c and 6b, 6c is equal to the distance between the axes of conduits 11, 12 and 13, 14. The housing 1a is sealed at one of its ends by a plug 32 and at its other end by a plug 26 which comprises at one of its ends a lug 46 perpendicular to its axis which is engaged in a groove 47 provided in the movable member 2, on a different generatrix from that of the holes, said groove being open at one of its ends. The plug 26 has an external element 26b which is of hexagonal shape for driving the plug hence the movable member 2, by means of the lug 46 engaged in the groove 47 of the movable member. It is possible, with this arrangement to hold the movable member 2 in a predetermined angular position, without preventing its longitidunal displacement.

Figure 29:
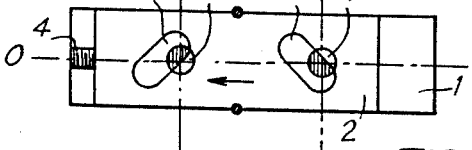
FIGS. 29 to 34 are views of the movable member in various positions with respect to the body.
Figure 30:
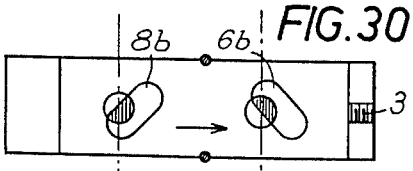
Figure 31:
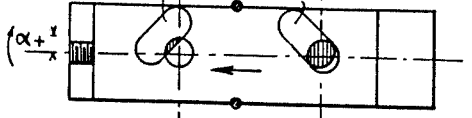
Figure 32:
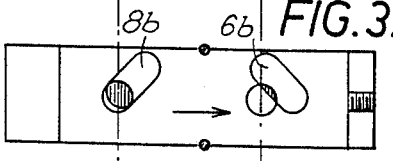

In FIG. 29, the movable member 2 is shown in a neutral angular position resting against the stop screw 4, whereas in FIG. 30, it is in resting position on the stop screw 3. In this case, the through orifices are equal. With the same adjustment of screws 3 and 4, FIGS. 31 and 32 show the movable member 2 which has been moved in rotation of an angle $\alpha+$ and for the two alternations, left and right, the admission flow has the priority over the exhaust flow.

Figure 33:
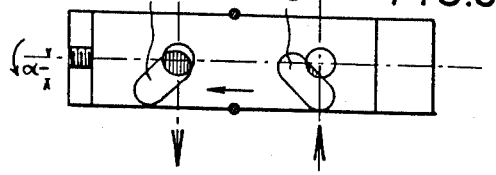
Figure 34:
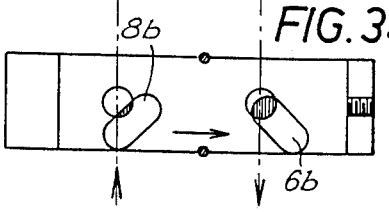

With the same adjustment of screws 3 and 4, FIGS. 33 and 34 show the movable member 2 which has been pivotated over an angle $\alpha-$ and for the two alternations, left and right, the exhaust flow has the priority over the admission flow.

Another embodiment of a flow regulating device illustrated in FIGS. 35 to 40 comprises, as in the preceding example, a rotary plug 26a, which is extended on one side by a part of hexagonal cross-section 26c, engaged in a hole 41, of corresponding cross-section provided at one of the ends of the movable member 2 so that the latter can be driven in rotation and in axial translation.

Figure 35:
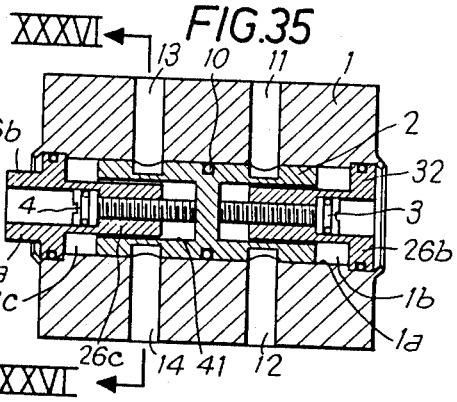
FIG. 35 is an axial section of another embodiment of a flow regulating device equipped with means of operating the movable member.
Figure 36:
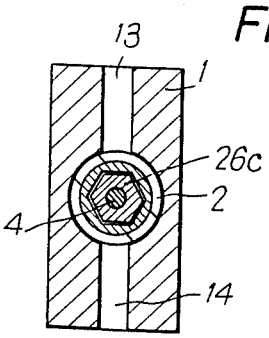
FIG. 36 is a cross-section along line XXXVI—XXXVI of FIG. 35.
Figure 40:
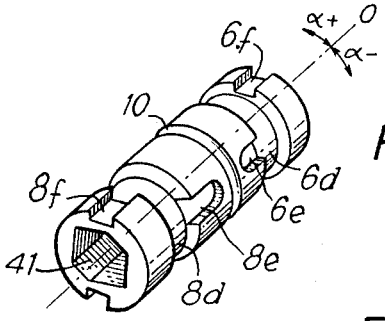
FIG. 40 is a perspective view of the movable member shown in FIGS. 37 to 39.

At the other end, the plug 26a is extended externally by a part 26b, of hexagonal shape, for driving the plug 26a (FIGS. 35–36 and 40).

The movable member 2 shown in FIG. 40 comprises on each side of the seal 10 two grooves 8d, and 6d which are extended by two longitudinal grooves extending in opposite directions, grooves 8a and 8f corresponding to groove 8d and grooves 6e and 6f corresponding to groove 6d. The grooves 8e and 8f are situated on the same generatrix, which is different from that mentioned hereinabove. With respect to a mean generatrix, the axes of said grooves are offset of an angle $\alpha+$ and $\alpha-$. The width of said grooves is substantially equal to the diameter of the passageways 11, 12 and 13, 14 at their outlet into the housing 1a of the movable member and the distance separating them on the circle is also equal to said diameter.

Figure 37:
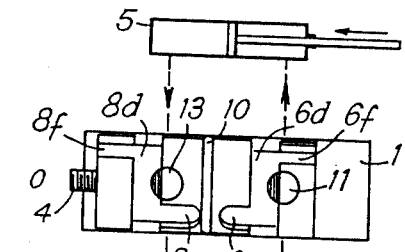
FIGS. 37 to 39 are views of the movable member in different positions.

FIG. 37 shows the movable member in abutment on the screw 4 which regulates the entering speed of the rod of jack 5. In the neutral angular position illustrated in the figure, the values of the passage orifices of the in and out flows are equal.

Figure 38:
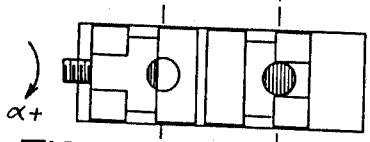

In FIG. 38, for the same adjustment of the screw 4, the movable member 2 has been rotated of an angle $\alpha+$ and only the return flow is reduced.

Figure 39:
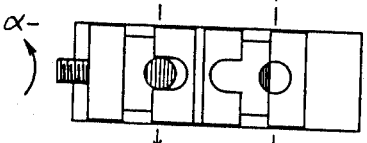

In FIG. 39, for the same adjustment of screw 4, the movable member 2 has been rotated of an angle $\alpha-$ and only the outgoing flow is reduced.

Figure 41:
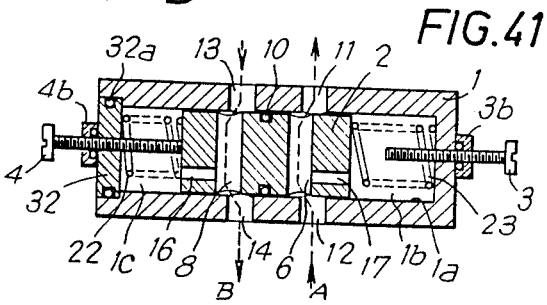
FIG. 41 is an axial section of a flow regulating device equipped with return springs.

In FIG. 41, there is shown a flow regulating device which is identical to that shown in FIG. 6, except that it comprises two return springs 22, 23 acting on both sides of the movable member 2. Said springs 22, 23 which are very weak, have no influence whatsoever during the cycles of pressure on the movable member 2; however, when the device is in non-working, under the pressurized fluid, they permit the manual operation of the jack, especially in the case of a breakdown.

Figure 42:
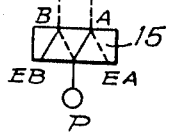
FIG. 42 is an axial section of another embodiment of the flow regulating device according to the invention.
Figure 42:
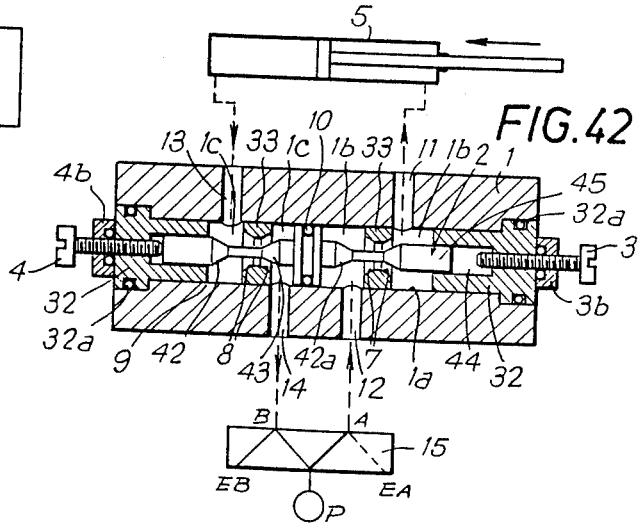

FIG. 42 shows a variant embodiment of a flow regulating device in which the housing 1a comprises two throttling members 33 comprising an orifice with two double cones 8 and 7 which cooperate with conical parts 42, 43 and 42a, 43a of the movable member 2 and regulate the passages hence the flows. The two chambers 1b and 1c, are isolated by the seal 10 mounted on the central part of the movable member.

Said throttling members 33 are respectively placed between the orifices of the portions of conduits 11 and 12 and between the orifices of the portions of conduits 13 and 14.

The plugs 32 are each provided with a blind hole 44 in which is mounted each end 45 of the movable member for the guiding thereof.

Obviously the invention is not restrictive and anyone skilled in the art can bring modifications thereto without departing from the scope of the invention.

What is claimed is:

1. Improvement in compressed air flow regulating devices mounted between a conventional distributor of compressed air and a pneumatic jack, in order to regulate the speed of a piston of a jack in each direction, characterized in that it comprises a body (1) having a cylindrical housing (1a) limited by two bottoms (32) and in which is mounted for axial sliding an axi-symmetrical movable member (2), of which the stroke is defined at each end of the housing by an adjustable stop means, said body (1) being traversed perpendicularly to said cylindrical housing (1a) by two passageways (11, 12 and 13, 14) supplying the jack (5) said passageways (11, 12 and 13, 14) each one issuing into a chamber (1b, 1c) both of which are defined by the bottom, the cylindrical housing (1a) and the movable member (2), said movable member (2) comprising a central seal (10) isolating the two chambers (1b, 1c) defined at both ends of the cylindrical housing (1a), said movable member (2), being bistable and ensuring the opening of the passageways (11, 12 and 13, 14) as a function of the position of the stop members (3, 4) situated at both ends of said housing, so that as a result, a regulation of the supply and draining air flows is achieved in the two volumes of air of the double acting jack (5), and this in every direction of displacement of the jack piston.

2. Improvement to flow regulating devices according to claim 1, characterized in that the body (1) is made in at least two pieces.

3. Improvement to flow regulating devices according to claim 1, characterized in that the stroke of the movable member is regulated by stop screws, (3, 4) provided with an annular seal (3a and 4a).

4. Improvement to flow regulating devices according to claim 3, characterized in that the stop screws (3, 4) are immobilized against vibrations by means of locknuts (3b and 4b).

5. Improvement to flow regulating devices according to claim 1, characterized in that the movable member (2) equipped with an annular seal (10) constitutes a piston subjected to the driving force of the pressurized fluid directed alternately on the two opposite faces of said movable member, due to the fact that one of the chambers (1b, 1c) is pressurized and the other chamber (1c, 1b) is in air expelling pressure, or decreasing pressure.

6. Improvement in flow regulating devices according to claim 1, characterized in that the movable member (2) is constituted by a single cylindrical hollow part (2c), comprising a central partition (2f), and an annular groove (2g) in which is placed a seal (10), isolating the two separate chambers (1b and 1c).

7. Improvement in flow regulating devices according to claim 1, characterized in that the movable member (2) is constituted of two identical or complementary elements (2a, 2b) assembled together by means of a rivet or screw (2d), said elements defining between them a housing inside which is placed a seal (2e), fitted about the rivet or screw, said assembly of said elements facilitating the passage of the seal (10) opposite the conduits (13, 14 and 11, 12) inside said housing (1a) of the body (1).

8. Improvement in flow regulating devices according to claim 1, characterized in that the movable member (2) is constituted of a single cylindrical hollow part (2c), comprising a central partition (2f), and tightness is achieved on its external diameter by an annular seal (10) fitted inside a groove (1d) of the body (1).

9. Improvement in flow regulating devices according to claim 1, characterized in that the movable member (2) closes more or less, depending on the adjustment of stops (3, 4), the passageways or conduits (11, 12 and 13, 14) by its circular edge (34) which moves over the passage orifices, the length of the cylindrical part of said member with respect to the distance between passageways (11, 12 and 13, 14) permitting to regulate the supply flow with respect to the exhaust flow or to slow down the flow solely on the exhaust of the jack.

10. Improvement in flow-regulating devices according to claim 1, characterized in that the movable member (2) is provided in its cylindrical wall situated on either side of the central partition (2f), with at least one hole (6,8) of cross-section substantially equal to that of the orifices of the passageways (11, 12 and 13, 14), the distance between the holes of the movable member (2) permitting to vary the proportion of the flows between the exhaust and the supply, said movable member 2 being immobilized in rotation.

11. Improvement in flow regulating devices according to claim 1, characterized in that the movable member (2) is provided on its cylindrical part with two grooves (2h, 2i) one of which (2h) corresponds to one of the chambers (1c) and the other (2i) corresponds to the other chamber (1f), the widths of said grooves (2h, 2i) and the distance between them permitting, depending on their value, to vary the supply or exhaust flow by privileging either the exhaust or the supply.

12. Improvement in flow regulating devices according to claim 1, characterized in that the movable member (2) comprises in its cylindrical part, oblong grooves (8e and 6e), which are rectilinear and issue into grooves (8d, 6d) with flowing grooves (8f and 6f), said movable member (2) being adapted, in addition to its axial movement limited by the stops, to be driven in rotation by an operating member (26a) of hexagonal shape mounted for sliding in a housing (41), of corresponding shape provided at one of the ends of said movable member (2).

13. Improvement in flow regulating devices according to claim 1, characterized in that the movable member (2) comprises in its cylindrical part, oblong apertures (8b, 6b) (8c, 6c) which are inclined with respect to the movable member, said movable member (2) being adapted, in addition to its axial movement, to be driven in rotation by an operating member equipped with a lug (46) mounted for sliding in a groove (47) of the movable member (2), and permitting the rotation and axial displacement of the latter.

14. Improvement in flow regulating devices according to claim 1, characterized in that the movable member (2) is provided with oblong orifices (8, 8a) and is adapted, in addition to its axial movement, to be driven in rotation by an operating member constituted of a flange (48) having a lug (27) mounted for sliding in a hole (40) provided in said movable member (2), said flange (48) being mounted on the body (1) by way of screws (28, 29) engaged in apertures (38, 39) provided in said flange (48) and permitting its angular displacement.

15. Improvement in flow regulating devices according to claim 1, characterized in that the screws (3, 4) for adjusting the stroke of the movable member (2) have their head embedded in a hole (32c) of cylindrical shape, provided in a plug (32), secured to at least one of the ends of the housing (1a) provided in the body (1), said head of the screw having a groove in which is engaged a seal (3a, 4a) which also ensures the slowing down in rotation of the screw under the action of vibrations.

16. Improvement in flow regulating devices according to claims 1 or 15, characterized in that the cylindrical holes (32c), receiving the screw heads, (3, 4) are adapted to receive closing members (31) provided with a tight seal (31a), which is engaged in a groove (32a) of the plugs (32).

17. Improvement in flow regulating devices according to claim 1, characterized in that the cylindrical housing (1a) provided in the body (1) is closed at one of its ends by a plug (32), and at its other end by a partition provided in the body (1).

18. Improvement in flow regulating devices according to claim 1, characterized in that the cylindrical housing (1*a*) provided in the body (1), is closed at both ends by identical plugs (32) which are, either force-fitted into the housing (1*c*), or fitted in abutment in a short shouldered housing, or fitted in and crimped, or screwed on the body (1*c*).

19. Improvement in flow regulating devices according to claim 1, characterized in that in the cylindrical housing (1*a*), are force-fitted two throttling members (33) of which the orifice presents two cones (7, 8) which cooperate with two cones (42, 43) provided on the movable member (2), thereby adjusting the passage orifices and the flows of the two chambers (1*b* and 1*c*), said movable member (2) having at its two ends, guiding members which are engaged in holes provided in the plugs (32).

20. Improvement in flow regulating devices according to claim 1, characterized in that the movable member (2) which is bistable under the action of the driving pressure is also subjected at its two ends to the action of two return springs (22, 23), which are very weak and without any influence on the pressure cycles, and which return the movable member (2) in a central position, thus ensuring the passage towards the orifices of the jack when the device is not working and pressureless, and thus permitting the manual operation of the jack.

* * * * *